United States Patent [19]

Dobbie

[11] Patent Number: 4,997,017

[45] Date of Patent: Mar. 5, 1991

[54] THICKNESSING MACHINE

[75] Inventor: Everett N. Dobbie, Durham, England

[73] Assignee: Wadkin PLC, Leicester, England

[21] Appl. No.: 449,523

[22] Filed: Dec. 12, 1989

[30] Foreign Application Priority Data

Dec. 16, 1988 [GB] United Kingdom ..... 8829375

[51] Int. Cl.[5] ..... B27C 1/12

[52] U.S. Cl. ..... 144/128; 144/117 R; 144/245 A; 198/851

[58] Field of Search ..... 144/114 R, 117 R, 128, 144/242 D, 242 M, 242 R, 245 R, 245 A; 198/850, 851

[56] References Cited

U.S. PATENT DOCUMENTS

| | | | |
|---|---|---|---|
| 2,595,879 | 5/1952 | Pasquier | 144/245 A |
| 2,732,867 | 1/1956 | May et al. | 144/128 |
| 3,379,230 | 3/1968 | Roehrig | 144/128 |
| 4,881,584 | 11/1989 | Wislocker et al. | 144/245 A |

FOREIGN PATENT DOCUMENTS

| | | | |
|---|---|---|---|
| 1194895 | 11/1955 | France | 198/851 |
| 57478 | 12/1935 | Norway | 144/128 |
| 655465 | 7/1951 | United Kingdom . | |
| 849300 | 9/1960 | United Kingdom . | |
| 902519 | 8/1962 | United Kingdom . | |
| 1453777 | 10/1976 | United Kingdom . | |

*Primary Examiner*—W. Donald Bray

*Attorney, Agent, or Firm*—Rodman & Rodman

[57] ABSTRACT

An improved timber thicknessing machine comprises a support frame, at least two parallel, continuous drive chains, a multiplicity of slats disposed in spaced parallel positions extending between the drive chains to form a continuous belt, a rotary cutter block disposed above the belt generally parallel to the slats and having cutter blades around its circumference, rollers above the belt on each side of the cutter block to cooperate with the belt in advancing a workpiece through the machine, and pressure bars resiliently mounted above the belt between the respective rollers and the cutter block to urge the workpiece towards the belt.

6 Claims, 2 Drawing Sheets

THICKNESSING MACHINE

Figure 1:
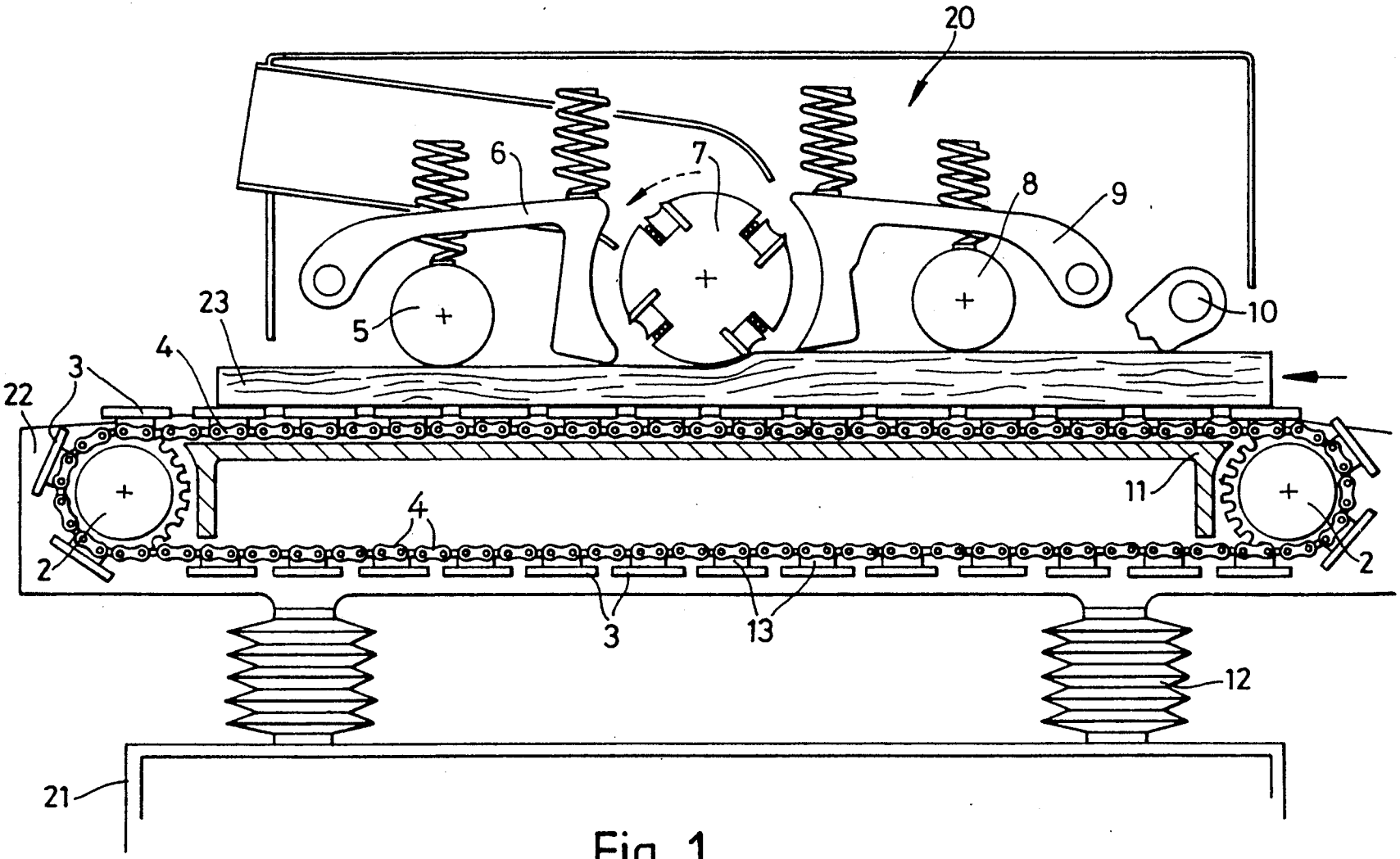

The present invention is an improved machine of the type known as a "thicknessing machine".

In the timber shaping industry, various machines are employed for removing parts of the surface of cut lengths of timber with the object of producing a more uniform surface and/or modifying the profile of the wood. The range of machines conventionally used includes planing machines and thicknessing machines. While the function of a planing machine is to shave the wood so as to produce a flat surface, a thicknessing machine is employed to cut a piece of wood to a uniform thickness; that is, the wood produced by a thicknessing machine has its two opposite faces cut parallel, but not necessarily flat.

In a thicknessing machine, the feedstock is fed at a uniform speed to a rotating cutter block, which has a number of knives, usually two, three or four, disposed around its circumference parallel to its axis. The wood is usually fed to the cutter block by a feed roller and is held firmly down against the flat table of the machine by spring-loaded transverse pressure bars disposed to the front and rear of the cutter block. A further roller located behind the rear pressure bar assists transport of the wood through the machine.

In order to ensure that the feedstock is kept moving through the machine against the resistance presented by the cutter block and pressure bars, it is necessary to provide some form of moving support for the underside of the workpiece. This usually takes the form of one or more rollers disposed below the table of the machine and set with their upper circumference either level with the table surface or projecting to a small extent above that surface. Unfortunately, the use of under-table rollers carries with it many problems. For example, if the rollers are set above the table surface, as when required to feed wet timber, there is a tendency for a complementary scallop or transverse hollow to be cut in the upper surface of the wood. In addition, under-table rollers tend to pack with small wood chips and thus damage the underside of the workpiece. The need for frequent cleaning of such under-table rollers is a major inconvenience.

It is recognised that the ideal thicknessing machine would have no under-table rollers but no satisfactory alternative feed, especially for wet timber, has hitherto been devised. It has been proposed to replace the table by a continuous rubber belt and, while this overcomes the disadvantages characteristic of under-table rollers, it introduces some disadvantages of its own. For example, wood shavings under the belt are difficult to remove. In addition, there is a tendency for the belt to track towards that one of its sides which is subjected to greater use. With resinous wood, a continuous rubber belt may tend to slip over the wood surface. Finally, when it becomes necessary to repair or replace the belt, the whole of the belt and its supporting "table" may have to be lifted from the machine, an exercise which may even require some lifting equipment in the case of the larger machines.

Thus there is clear room for improvement in the workpiece driving arrangements for timber thicknessing machines. It is an object of the present invention to provide an improved thicknessing machine wherein some at least of the disadvantages associated with prior such machines are reduced or eliminated.

The timber thicknessing machine according to the present invention includes a cutter block, upper pressure rollers and pressure bars like a conventional thicknessing machine but the workpiece is supported upon a continuous belt formed of transverse slats, spaced at regular intervals from each other and carried at their ends upon a pair of continuous drive chains. Thus the machine comprises a support frame, at least two parallel, continuous drive chains, a multiplicity of slats, disposed in spaced parallel positions extending between the drive chains so as to form a continuous belt of spaced transverse slats, a rotary cutter block disposed above the belt with its axis of rotation generally parallel to the slats and having a plurality of cutter blades disposed around its circumference, rollers disposed above the belt on each side of the cutter block to cooperate with the belt in feeding a workpiece to and from the cutter block, and pressure bars, resiliently mounted above the belt between the respective rollers and the cutter block to urge the workpiece towards the belt.

The slats of which the belt is formed are preferably each removable attached to the drive chains so that they may readily be individually replaced when worn or damaged. They may be of rigid or semi-rigid material and may be plain or coated. For example, in one form they may be of rubber-coated or plastics-coated metal. In one much preferred form of the invention, however, the slats are formed of a hard natural or synthetic rubber, especially a rubber laminate. Whatever the material of the slats, it is preferred that their upper surface, that is, the surface which supports the workpiece, should be of high frictional characteristics, for instance enhanced by surface features or irregularities. Preferably the under surface is of low friction.

The slats are spaced apart along the drive chains. Typically the distance apart of each pair of adjacent slats is a fraction of the width of each slat, for example between one tenth and one third of that width. For example, the slats may be of the order of 30 mm wide and spaced apart by gaps of the order of 5 mm wide.

The drive chains may conveniently each extend between a pair of sprockets, one of which provides the drive to the chain. Preferably the drive sprockets are driven by an electric motor which preferably is a separate source of power from that by which the cutter block is driven but the same source of power may be used if desired.

While the slatted belt of the present invention takes the place of a conventional table and under-table rollers, nonetheless it is preferred to have a flat support surface resembling the usual table below the upper length of the slatted belt, upon which the underside of the slats may be supported in use. The support may be sufficiently narrow to fit between the two drive chains or may be wider and provided with longitudinal parallel channels to accommodate the chains.

Figure 2:
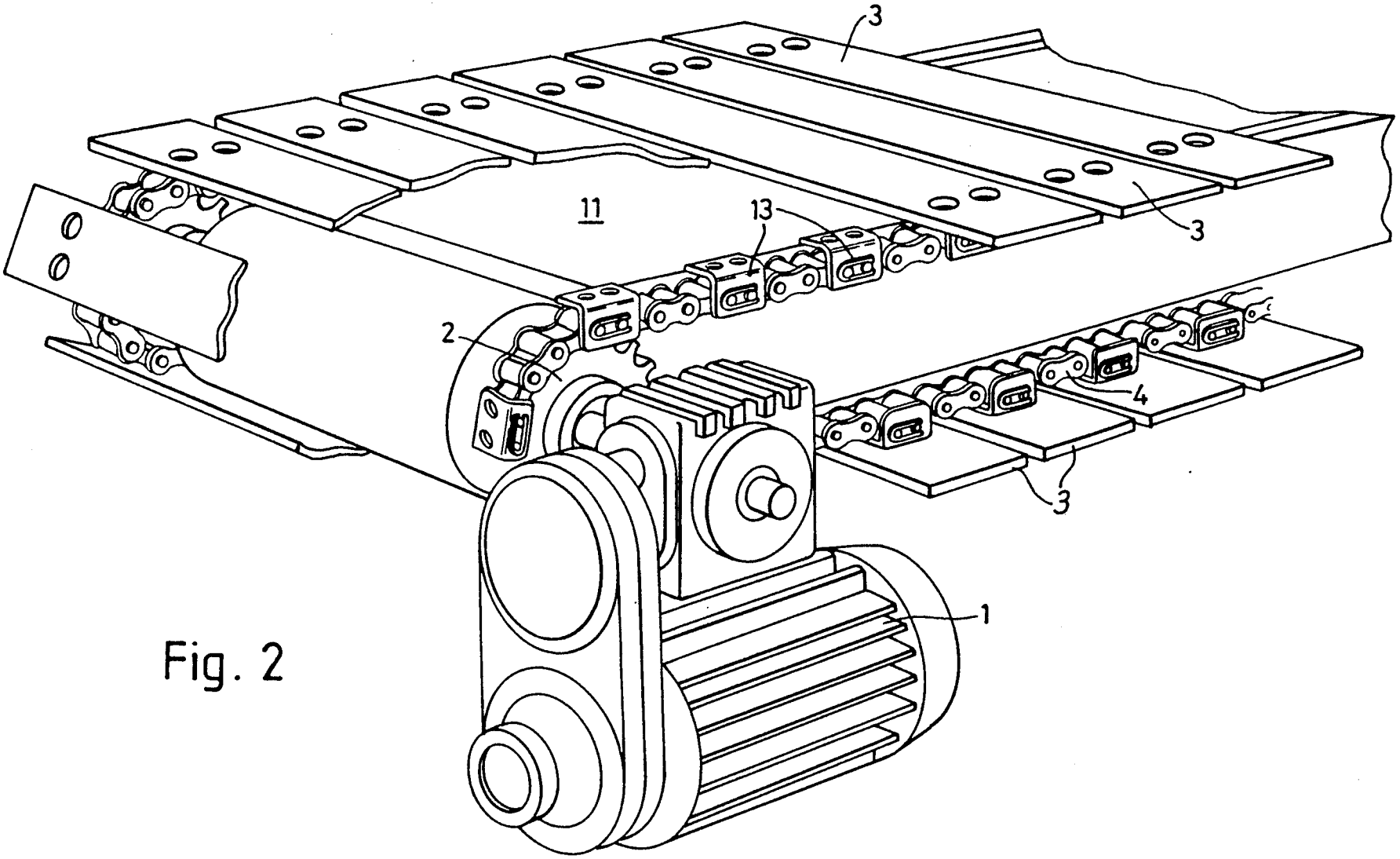

The invention will now be further described, by way of example only, with reference to the accompanying drawings, which illustrate one preferred embodiment of the thicknessing machine according to the present invention and wherein:

FIG. 1 is an elevation, partly in section, from one side of the machine; and FIG. 2 is a perspective view, to a somewhat larger scale, of one end of the machine of FIG. 1.

The illustrated machine comprises a cutter assembly, identified generally by the reference numeral 20, rigidly mounted above a base frame 21. A table assembly 22 is separately mounted on the base frame 21 by means of a rise-and-fall mechanism 12, by means of which the height of the table assembly above the base frame, and therefore the vertical distance between the cutter assembly 20 and the table assembly 22, may be varied to reflect the desired final thickness of a workpiece 23.

The cutter assembly 20 comprises a rotary cylindrical cutter block 7, driven by an electric motor not shown in the drawings, and a series of devices provided to assist the advancement of the workpiece 23 past the cutter block in the direction of the solid arrow (from right to left in FIG. 1). These include an infeed pressure roller 8 and outfeed pressure roller 5, each mounted so as to be free to rotate, and infeed and outfeed pressure bars 9 and 6 respectively. Each of these four devices is sprung downwardly as illustrated in order to maintain the workpiece 23 in close contact with the slats 3 of a slatted drive belt, described in more detail below. At the feed or input end of the cutter assembly 20 is pivoted a row of parallel anti-kick-back fingers 10, which are cam-like devices designed to ensure that, if the workpiece is forced backwardly by the cutter block, it is not thrown out of the machine and does not therefore put the operator at risk.

The table assembly 22 comprises a pair of parallel continuous chains 4, disposed in parallel channels (not shown) at the opposite sides of a solid flat support table 11. The chains 4 extend between pairs of sprockets 2, one of each pair being driven by a motor 1 (FIG. 2), via a mechanism whereby the speed of the drive may be varied over a continuous range of speeds. Alternate links in the chains 4 carry brackets 13, by means of which a series of slats 3 are mounted in mutual parallel across from one chain to the other down the full length of the chains. Each slat 3 is secured to two brackets 13 by four screws, so that a slat may readily be removed and replaced without removing the remaining slats or the chains from the machine.

The individual slats 3 are formed from a rubber/fabric laminate of which the outer surface (that is, the surface which comes into contact with the workpiece) is embossed with a fine pattern to enhance its frictional grip on the workpiece. In the illustrated embodiment, the slats are each about 30 mm wide and they are separated by spaces of approximately 5 mm but these dimensions may be greater on larger machines. In operation of the machine, the slats in the upper half of the belt which they combine to form are supported by the table 11.

While the improved thicknessing machine according to the invention has many similarities to some prior such machines, the continuous "belt" formed by slats imparts several important and unexpected advantages. In particular, regular maintenance is much easier to implement than with a non-slatted belt in that the belt may be repaired without removing it from the machine—and only the worn or damaged slat or slats need be replaced. It is also found that the tendency to track sideways which is characteristic of a non-slatted belt is eliminated by the adoption of a slatted belt.

Cleaning of the belt becomes easier and need be carried out less frequently, since any wood shavings which are carried between the slats are simply dropped out as the belt opens up over the sprockets at its end.

Most important of all, the disadvantages inherent in the use of under-table rollers are completely avoided, without any loss of performance of the machine.

I claim:

1. An improved machine for trimming a timber workpiece to a predetermined uniform thickness which comprises:

(a) a support frame;

(b) at least two parallel, continuous drive chains supported upon said support frame;

(c) each said drive chain extending longitudinally between a pair of sprockets, one of which sprockets drives the chain;

(d) drive means to drive said sprockets;

(e) a multiplicity of slats, each extending transversely across said drive chains;

(f) means for joining said slats to said drive chains in spaced and parallel relationship whereby said slats and said chains form a continuous belt of spaced transverse slats;

(g) said slats further being formed of a hard rubber;

(h) each of said slats having an outside surface adapted to contact the workpiece and having enhanced frictional characteristics for gripping the workpiece and an inside surface that does not contact the workpiece and having low frictional characteristics for relative slidability with respect to said support frame;

(i) a flat support surface supported upon said support frame to engage the low-friction surface of the slats such that the slats are slidable thereon;

(j) a rotary cutter block supported upon said support frame in a position above the belt with its axis of rotation generally parallel to said slats;

(k) said cutter block having a plurality of cutter blades disposed around its circumference;

(l) at least two rollers supported upon said support frame above the belt on each side of said cutter block to cooperate with said belt to feed said workpiece to and from said cutter block; and (m) at least two pressure bars resiliently mounted upon said support frame above the belt between the respective rollers and the cutter block to urge the workpiece against the belt.

2. A timber thicknessing machine according to claim 1, wherein the slats are each removably attached to the drive chains.

3. A timber thicknessing machine according to claim 1, wherein said drive means to drive said sprockets is an electric motor.

4. A timber thicknessing machine according to claim 3, wherein said electric motor is separate from the drive for the cutter block.

5. A timber thicknessing machine according to claim 1, wherein the distance apart of each pair of adjacent slats is between one tenth and one third of the width of each slat.

6. A timber thicknessing machine according to claim 1, wherein said flat support surface is provided with longitudinal channels to accommodate the chains.

* * * * *